US008296955B2

(12) United States Patent
Sato et al.

(10) Patent No.: US 8,296,955 B2
(45) Date of Patent: Oct. 30, 2012

(54) ELECTRIC SHAVER

(75) Inventors: Masaaki Sato, Hikone (JP); Takeshi Shiba, Hikone (JP); Jyuzaemon Iwasaki, Nagahama (JP)

(73) Assignee: Panasonic Corporation, Osaka (JP)

( * ) Notice: Subject to any disclaimer, the term of this patent is extended or adjusted under 35 U.S.C. 154(b) by 392 days.

(21) Appl. No.: 12/663,870

(22) PCT Filed: Jun. 13, 2008

(86) PCT No.: PCT/JP2008/060854

§ 371 (c)(1),
(2), (4) Date: Dec. 10, 2009

(87) PCT Pub. No.: WO2009/008244

PCT Pub. Date: Jan. 15, 2009

(65) Prior Publication Data

US 2010/0180447 A1 Jul. 22, 2010

(30) Foreign Application Priority Data

Jul. 12, 2007 (JP) ..... 2007-183625

(51) Int. Cl.
*B26B 19/04* (2006.01)
*B26B 19/06* (2006.01)

(52) U.S. Cl. ..... 30/43.92; 30/43.9

(58) Field of Classification Search ..... 30/43.92, 30/43.91, 45, 346.51, 34.1, 43.7, 43.8, 50, 30/89

See application file for complete search history.

(56) References Cited

U.S. PATENT DOCUMENTS

| | | | | |
|---|---|---|---|---|
| 5,231,761 | A * | 8/1993 | Heintke et al. | 30/43.92 |
| 5,551,154 | A * | 9/1996 | Tanahashi et al. | 30/43.92 |
| 5,704,126 | A * | 1/1998 | Franke et al. | 30/34.1 |
| 6,226,871 | B1 | 5/2001 | Eichhorn et al. | |
| 6,357,117 | B1 | 3/2002 | Eichhorn et al. | |
| 6,357,118 | B1 | 3/2002 | Eichhorn et al. | |
| 7,171,751 | B2 * | 2/2007 | Iwashita et al. | 30/43.91 |
| 2007/0022607 | A1 | 2/2007 | Takeuchi et al. | |
| 2007/0056166 | A1 | 3/2007 | Shiba et al. | |
| 2007/0245565 | A1 | 10/2007 | Sato et al. | |
| 2008/0256799 | A1 | 10/2008 | Shiba | |
| 2009/0172948 | A1 | 7/2009 | Kitamura | |
| 2009/0241343 | A1 | 10/2009 | Yamasaki et al. | |
| 2009/0307909 | A1 | 12/2009 | Sato et al. | |
| 2010/0126022 | A1 | 5/2010 | Shiba et al. | |

FOREIGN PATENT DOCUMENTS

EP 1685931 8/2006

(Continued)

OTHER PUBLICATIONS

China Office action, dated Dec. 21, 2010 along with an english translation thereof.

(Continued)

*Primary Examiner* — Ghassem Alie
(74) *Attorney, Agent, or Firm* — Greenblum & Bernstein P.L.C.

(57) ABSTRACT

An electric shaver in which a blade frame part is attached to an upper portion of a body part, the blade frame part including an outer blade, an outer blade frame to fix the outer blade thereto, a holding frame to hold the outer blade frame vertically movable, and an outer peripheral frame connected to the holding frame, the upper portion including an inner blade. The holding frame is detachably attached to the outer peripheral frame from an under side thereof, and the outer peripheral frame entirely covers an outer periphery of the holding frame.

5 Claims, 10 Drawing Sheets

FOREIGN PATENT DOCUMENTS

| | | |
|---|---|---|
| EP | 1886776 | 2/2008 |
| EP | 1935585 | 6/2008 |
| JP | 3-967 | 1/1991 |
| JP | 4-220282 | 8/1992 |
| JP | 4-505868 | 10/1992 |
| JP | 2002-315978 | 10/2002 |
| JP | 2005-73939 | 3/2005 |
| RU | 2170660 | 7/2001 |
| RU | 2175602 | 11/2001 |
| RU | 2000107114 | 1/2002 |
| WO | 99/10141 | 3/1999 |

OTHER PUBLICATIONS

Search report from E.P.O, mail date is Mar. 29, 2011.
Russia Office action, dated Feb. 25, 2011 along with an english translation thereof.
China Office action, dated Jun. 21, 2011 along with an english translation thereof.
Russia Office action, dated Jun. 7, 2011 along with an english translation thereof.
Japan Office action, mail date is Jul. 19, 2011 along with an English language translation thereof.

* cited by examiner (a)

(b)

(a)

(b)

(a)

(b)

(c)

ELECTRIC SHAVER

TECHNICAL FIELD

The present invention relates to an electric shaver for cutting hair.

BACKGROUND ART

There have been provided various electric shavers each configured to be used in a state in which a blade frame part including an outer blade is attached to a body part including an inner blade. In such an electric shaver, the inner blade is slid on the outer blade of the blade frame part attached to the body part, and hair such as a beard let in via blade holes in the outer blade is cut between the sliding inner blade and the outer blade.

Generally, in the electric shaver described above, the outer blade is provided vertically movable by giving a certain clearance between the blade frame part and the outer blade when they are attached together. With such a structure, however, the outer blade has a poor skin-following capability, and this poor following capability becomes problematic especially when multiple outer blades are provided.

To solve this, Japanese Unexamined Patent Application Publication No. Hei 4-220282, for example, proposes an electric shaver which, as shown in FIG. 10, includes: an outer blade cassette 11 formed of outer blades 5, outer blade frames 13 to respectively fix the outer blades 5 thereto, and a holding frame 14 to hold the outer blade frames 13 vertically movable; and an outer peripheral frame 12 to which the outer blade cassette 11 is detachably attached from above to form a blade frame part 4 (see the arrow in FIG. 10).

In the electric shaver having the above structure, each outer blade 5 itself is fixed to the corresponding outer blade frame 13 and thus held stable, whereas the outer blade frame 13 is allowed to move vertically with respect to the holding frame 14 in a smooth manner within a large range. Accordingly, the skin-following capability can be improved. In addition, in this electric shaver, replacement of the outer blades 5 only involves removal of the outer blade cassette 11 from the outer peripheral frame 12 and replacement with another one. Thus, the required work is simple. It is also economical since the outer peripheral frame 12 can be used again without replacement.

However, since the electric shaver provided with the above outer blade cassette 11 has a structure which allows the holding frame 14 of the outer blade cassette 11 to be attached to the outer peripheral frame 12 from above, it is inevitable that almost the entire outer periphery of the holding frame 14 in the attached state is exposed to the outside. This has been one of causes of spoiling its high quality impression.

To avoid this, it is conceivable for the above electric shaver that a surface treatment, for example, is performed to enhance the design of the holding frame 14 itself. Nonetheless, there are still a problem that a joint portion between the holding frame 14 and the outer peripheral frame 12 is largely exposed in a center of the blade frame part 4 and thus spoils the high quality impression, and a problem of difficulty in providing the outer blade cassette 11 as a replacement part at low cost.

DISCLOSURE OF INVENTION

The present invention has been proposed in view of the above problems, and thus provides an electric shaver capable of: improving the skin-following capability of an outer blade by including an outer blade frame and a holding frame; imparting a high quality impression by preventing the holding frame from being exposed to the outside; and saving the cost required for replacement of the outer blade.

An aspect of the present invention is an electric shaver in which a blade frame part is attached to an upper portion of a body part, the blade frame part including an outer blade, an outer blade frame to fix the outer blade thereto, a holding frame to hold the outer blade frame vertically movable, and an outer peripheral frame connected to the holding frame, the upper portion including an inner blade, the electric shaver characterized in that the holding frame is detachably attached to the outer peripheral frame from an under side thereof, and the outer peripheral frame entirely covers an outer periphery of the holding frame which is attached to the outer peripheral frame from the under side.

By the above structure, the outer peripheral frame is exposed to the outside without exposing the holding frame to the outside and also without exposing the joint portion between the holding frame and the outer peripheral frame to the outside. Accordingly, it is possible to impart a high quality impression to the whole blade frame part. In addition, since the holding frame is detachably attachable to the outer peripheral frame, the outer blade can be replaced with another easily by removing the outer blade together with the holding frame in a case where the outer blade is broken or degraded. Moreover, since the holding frame is not exposed to the outside, the cost for enhancing the design thereof is not needed, allowing provision of the holding frame at low cost.

It is preferred that the outer peripheral frame is attached to the body part with the holding frame therebetween in the electric shaver with the above structure. By such a structure, it is possible to make the blade frame part and consequently the whole electric shaver compact.

Further, it is preferred that the holding frame is attached to the body part in close contact therewith in the electric shaver. In this way, it is possible to seal debris of cut hair between the holding frame and the body part and thereby to prevent the hair debris from coming out.

Further, it is also preferred that a gap to allow a cleaning liquid to pass therethrough is provided between the holding frame and the outer peripheral frame in the electric shaver. In this way, the gap between the holding frame and the outer peripheral frame functions as a flow passage of a cleaning liquid when the blade frame part in the state of being attached to the body part is washed. Accordingly, it is possible to obtain a high cleaning effect.

Further, it is also preferred that an operation surface of a release button provided to release attachment of the holding frame to the body part, and an operation surface of another release button provided to release attachment of the outer peripheral frame to the holding frame are provided approximately flush with each other in the electric shaver. In this way, it is possible to manipulate both of the release buttons alternatively or simultaneously with the user' s fingers of one hand touching both of the flushly-arranged operation surfaces.

Further, it is also preferred that a through hole is provided in a side portion of the holding frame, the holding frame is attached to the body part by causing a hook provided to the body part to be hooked over a portion of the through hole, and the outer peripheral frame is attached to the holding frame by causing a hook provided to the outer peripheral frame to be hooked over another portion of the through hole in the electric shaver. In this way, it is possible to sufficiently secure the hook widths of the hooks, while saving the spaces for the connection structures and also lowering the cost by simplifying a mold structure.

It is to be noted that, in the electric shaver, any combination of the structures described above is possible as needed, as long as it does not depart from the gist of the present invention.

BEST MODE FOR CARRYING OUT THE INVENTION

Figure 6:
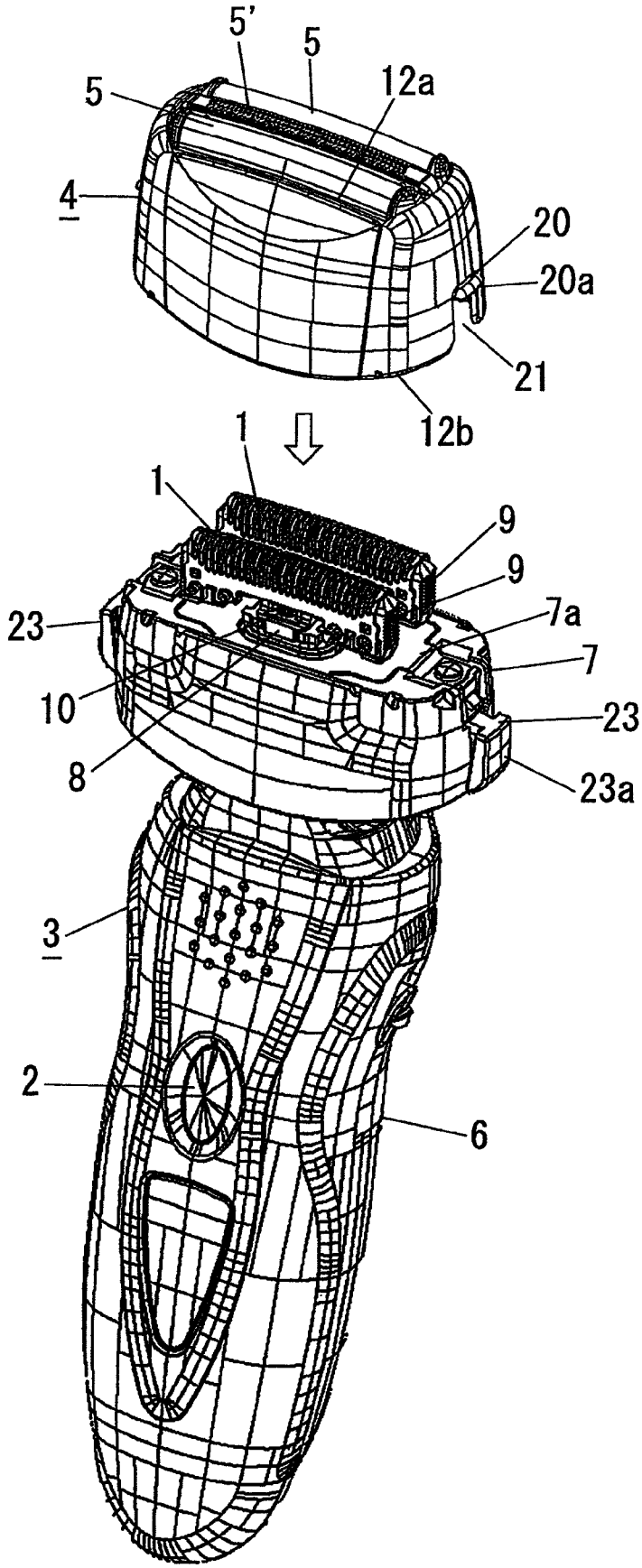
FIG. 6 is perspective view showing a state before the blade frame part is attached to the body part in the electric shaver of the embodiment.
Figure 7:
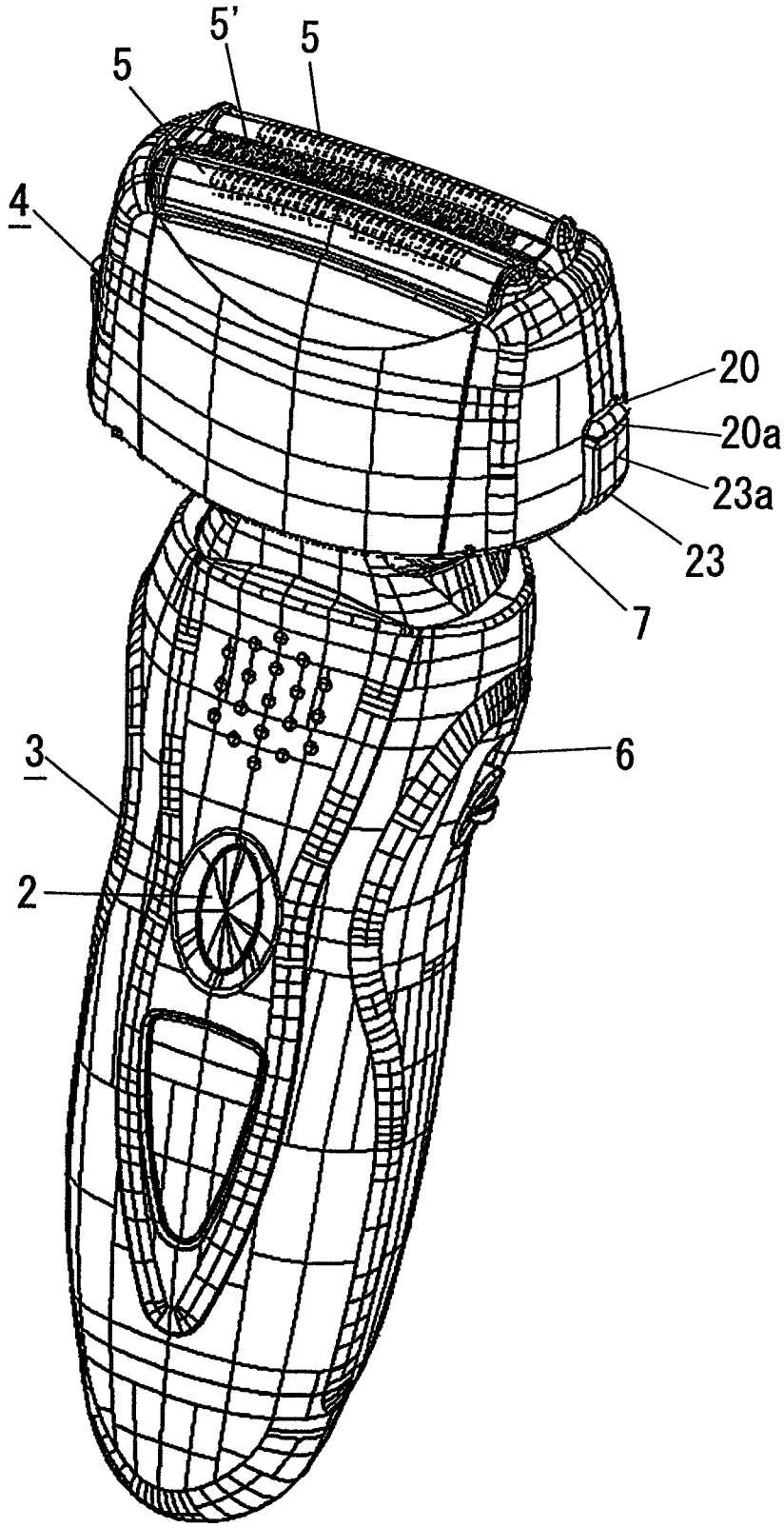
FIG. 7 is a perspective view showing a state where the blade frame part is attached to the body part in the electric shaver of the embodiment.

Hereinbelow, the present invention will be described based on an embodiment shown in the accompanying drawings. As the entire views in FIG. 6 and FIG. 7 show, an example of an electric shaver of the embodiment mainly includes a body part 3 and a cap-shaped blade frame part 4. The body part 3 includes a battery part provided therein (not shown) and also upwardly-protruding multiple inner blades 1 reciprocally driven by the battery part. The blade frame part 4 is detachably attached to an upper end portion of the body part 3 from above, the upper end portion including the inner blades 1.

In a blade surface in the upper end of the blade frame part 4, net-like outer blades 5 having many blade holes and a slit outer blade 5' having many grooves are disposed in parallel with one another. Moreover, in this electric shaver, a blade edge in the upper end of each of the inner blades 1 provided on the body part 3 side comes into elastic contact with an inner surface of a corresponding one of the outer blades 5 in a state where the blade frame part 4 is attached to the body part 3 as shown in FIG. 7.

Note that in the following text, description will be given while assuming that a side from which the blade frame part 4 is attached to the body part 3 is a "top side," the opposite side therefrom is an "underside," a side at which a switch part 2 is provided is a "front side," the opposite side therefrom is a "rear side," and a direction in which the inner blades 1 reciprocate is a "right-to-left direction."

First, the body part 3 will be described. The body part 3 is formed of: a grip part 6 including the battery part provided therein and the switch part 2 for operation which is exposed from a front surface of the body part 3; and a body head part 7 connected to an upper end portion of the grip part 6 slidably in front-to-rear and right-to-left directions. The body head part 7 which forms an upper portion of the body part 3 includes a linear motor provided therein (not shown) driven by a power supply from the battery part. In addition, drive rods 8 reciprocally driven by the linear motor are provided to protrude upward from a flat upper end surface 7*a* of the body head part 7. A pair of the drive rods 8 are arranged in the front-to-rear direction. Moreover, the inner blades 1 are detachably attached to the upper ends of the drive rods 8, respectively.

The inner blades 1 are fixed respectively to bases 9 in a state where the inner blade 1 are curved into a reversed U-shape so as to be upwardly convex. The bases 9 are connected to the drive rods 8, respectively. The drive rods 8 include push-up springs 10 respectively provided therein. A restoring force of each push-up spring 10 makes the corresponding inner blade 1 floatable vertically.

Note that the state described as "floatable" in the following text refers to a state where an object is movable vertically within a certain range and also is applied with a stronger upward biasing force as the object moves downward within that range.

Figure 1:
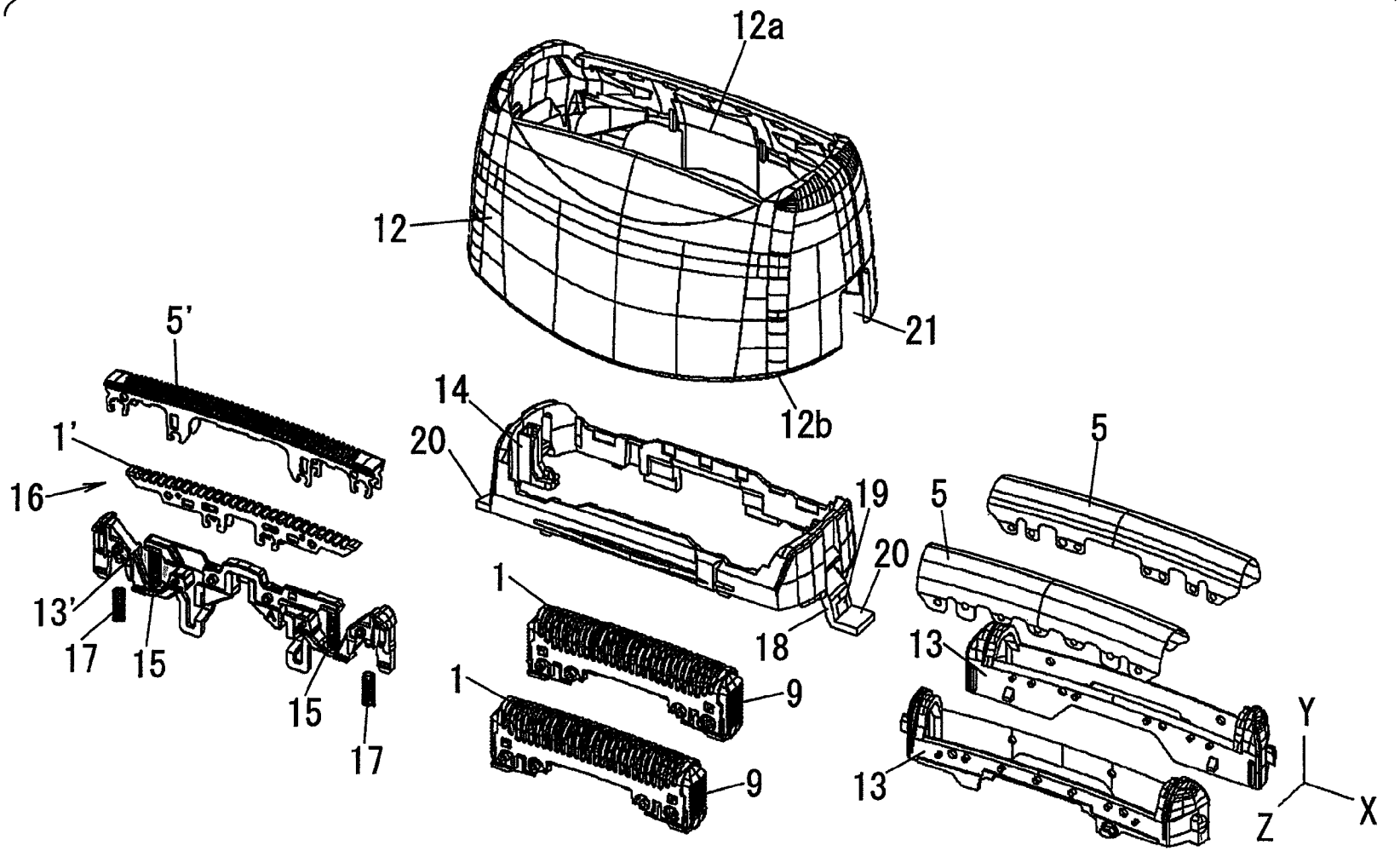
FIG. 1 is an exploded perspective view of inner blades and a blade frame part which are connected to a body part of an electric shaver of an embodiment.
Figure 2:
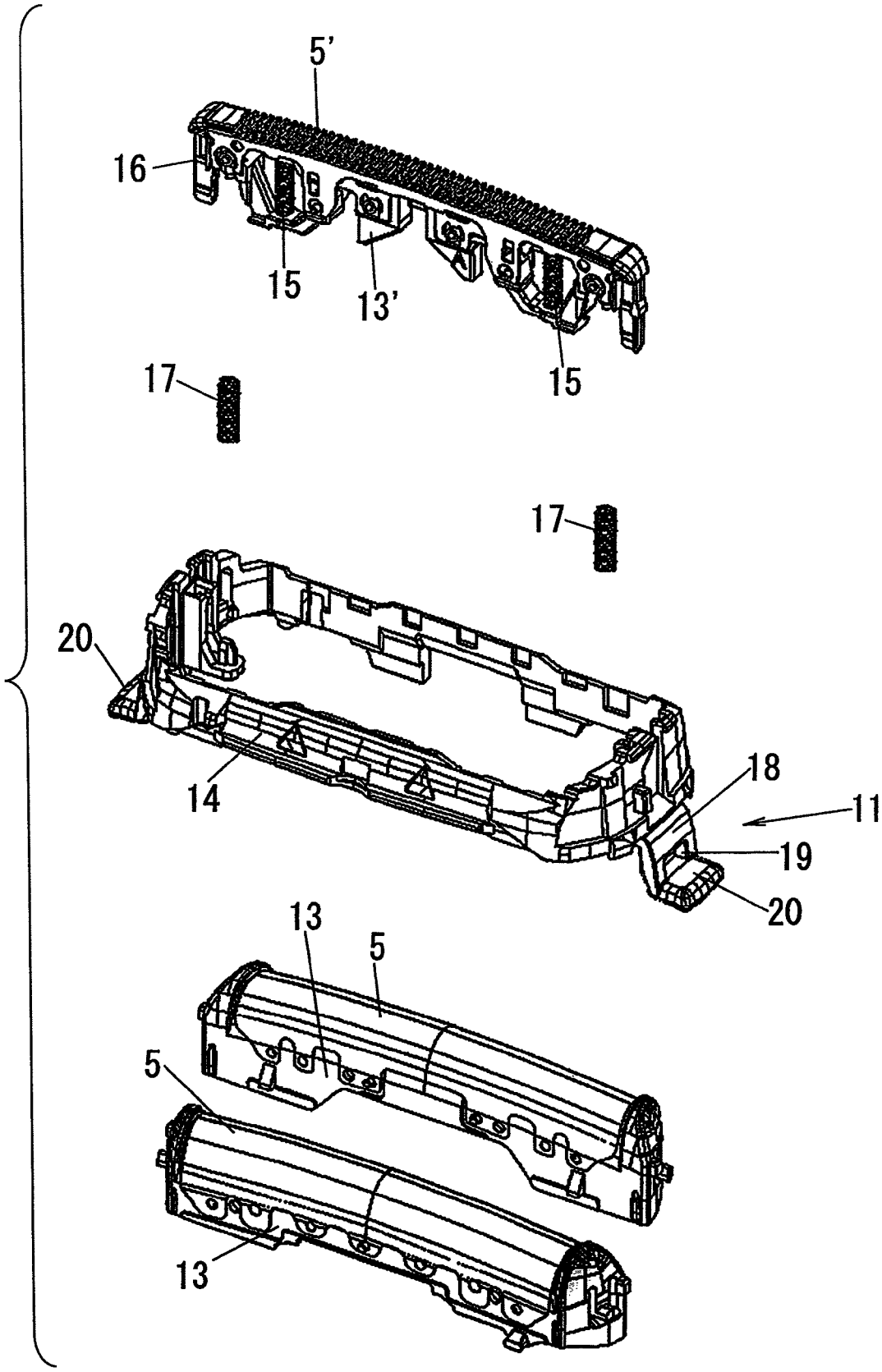
FIG. 2 is an exploded perspective view of an outer blade cassette housed inside the blade frame part of the electric shaver of the embodiment.
Figure 3:
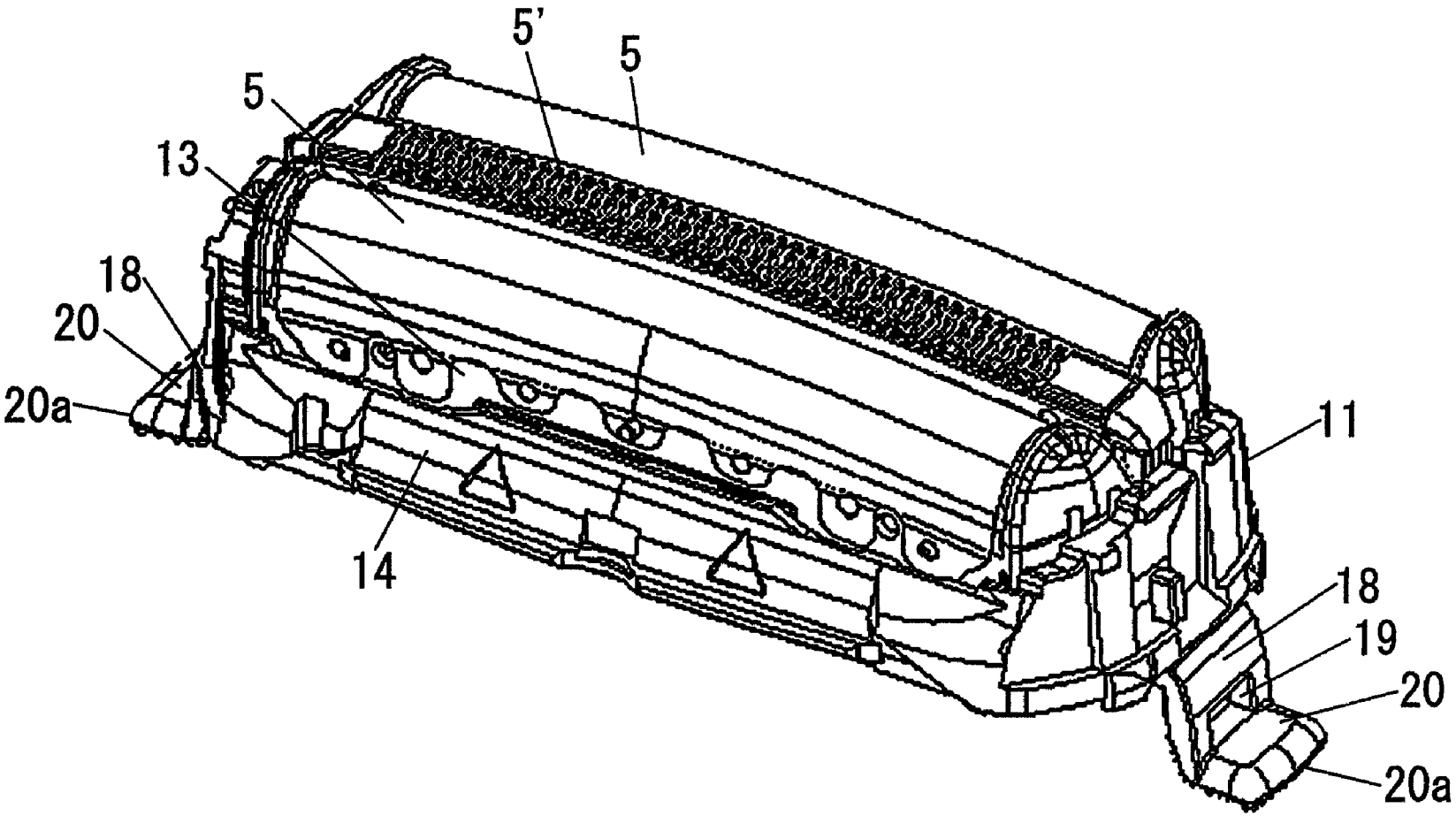
FIG. 3 is a perspective view of the outer blade cassette of the electric shaver of the embodiment.
Figure 4:
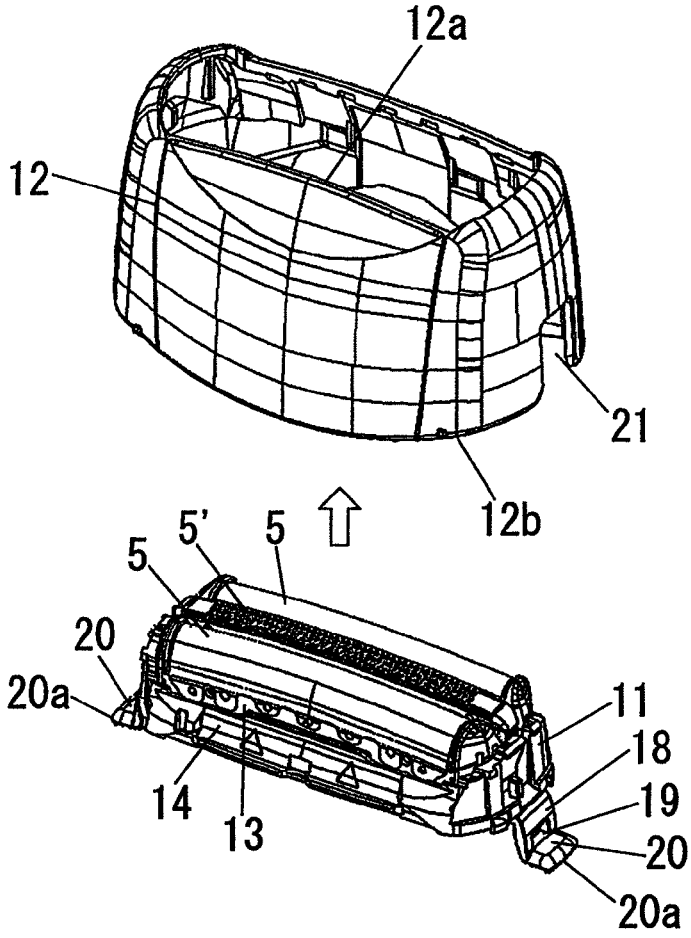
FIG. 4(*a*) is a perspective view showing a state before the outer blade cassette is attached to an outer peripheral frame in the electric shaver of the embodiment, whereas FIG. 4(*b*) is a perspective view showing a state after the attachment.
Figure 4:
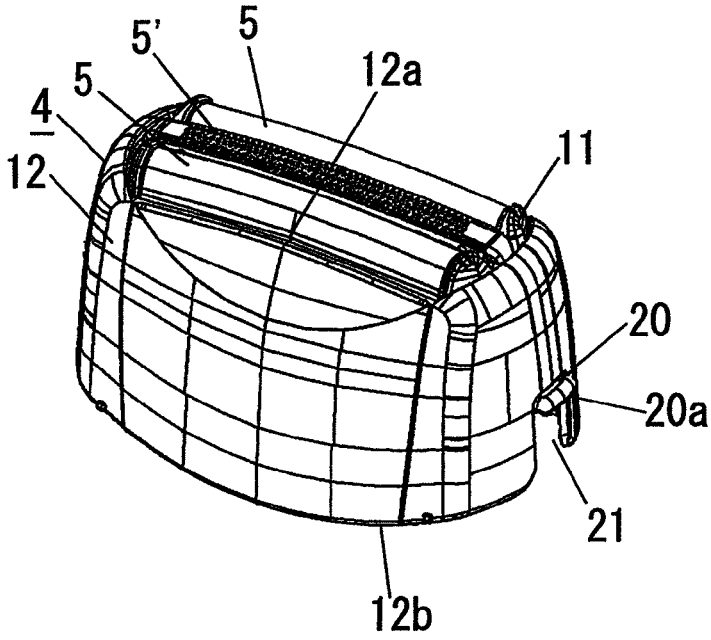
Figure 5:
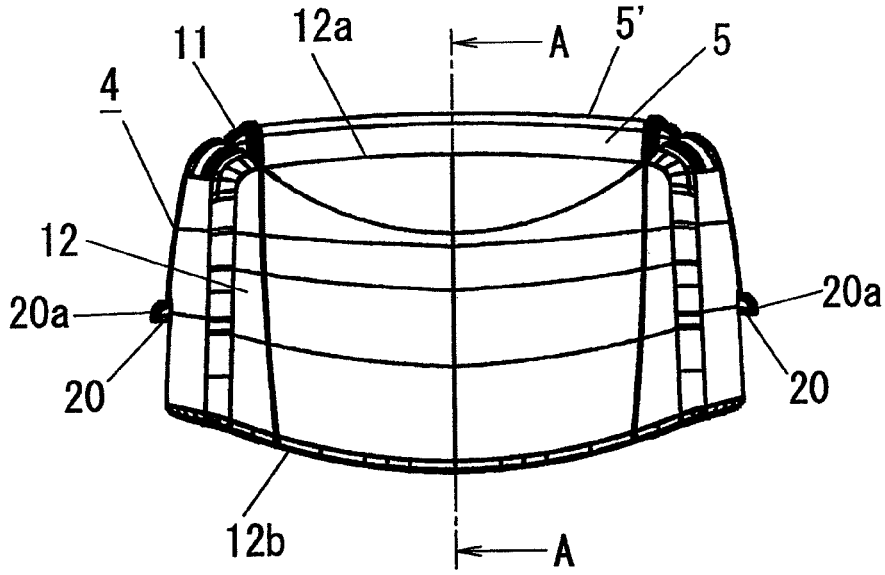
FIG. 5(*a*) is a front view showing the entire blade frame part of the electric shaver of the embodiment, and FIG. 5(*b*) is a cross-sectional view taken along the A-A line of FIG. 5(*a*).
Figure 5:
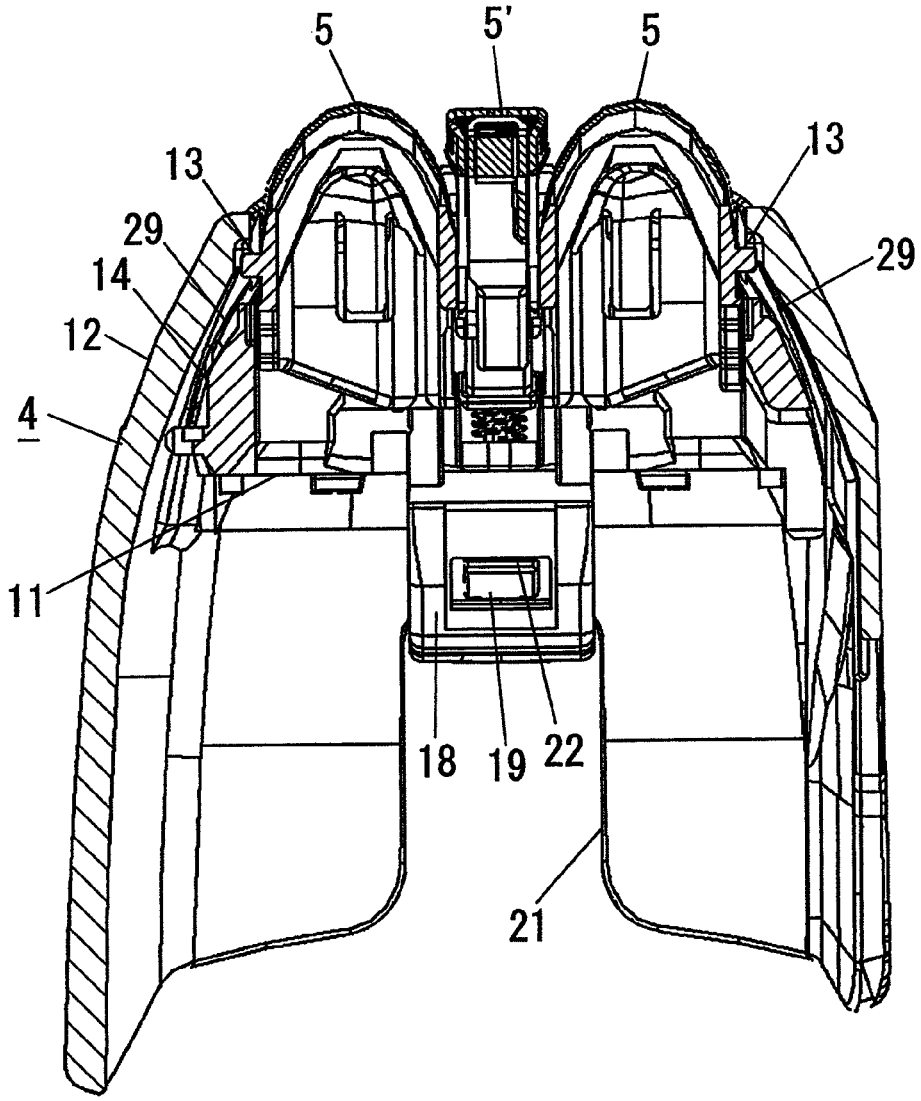

Next, description will be provided for the cap-shaped blade frame part 4 attached to the body head part 7, which is the upper portion of the body part 3, in such a way as to cover the entire body head part 7. The blade frame part 4 mainly includes a box-shaped outer blade cassette 11 and a tubular outer peripheral frame 12. The outer blade cassette 11 includes the multiple outer blades 5 and the slit outer blade 5' in a vertically movable manner, as shown in FIG. 2 and FIG. 3. The outer peripheral frame 12 covers the entire outer periphery of a holding frame 14 of the outer blade cassette 11 by housing and attaching the outer blade cassette 11 in and to the blade frame part 4 from the under side, as shown in FIG. 4 and FIG. 5.

The outer blade cassette 11 is provided with paired front and rear net-like outer blades 5 and one slit outer blade 5'. Both end portions of each of the net-like outer blades 5 are fixed to a rectangular outer blade frame 13 dedicated therefor in a state where the outer blade 5 is curved into a reversed U-shape so as to be upwardly convex. Each outer blade frame 13 is integrated independently in the holding frame 14 so as to be vertically movable. The holding frame 14 has a larger rectangular shape than the outer blade frame 13 has. The slit outer blade 5' is fixed to an upper portion of a slit outer blade frame 13' dedicated therefor. Like the outer blade frame 13, the slit outer blade frame 13' is integrated independently in the holding frame 14 so as to be vertically movable. The outer blade frames 13 for the outer blades 5 and the slit outer blade frame 13' for the slit outer blade 5' are disposed in parallel with one another inside the holding frame 14 in such an arrangement that the front and rear outer blade frames 13 sandwich the slit outer blade frame 13' located in the middle therebetween.

A slit inner blade 1' is provided between the slit outer blade 5' and the slit outer blade frame 13' so as to be slidable in the right-to-left direction. The slit outer blade frame 13' includes paired right and left slit springs 15. The slit springs 15 apply an upward elastic force to the slit inner blade 1' and accordingly a slit blade 16 in which the slit outer blade 5' and the slit inner blade 1' in elastic contact therewith are integrated is formed. Between the slit outer blade frame 13' and the holding frame 14, paired right and left push-up springs 17 are interposed to bias the slit outer blade frame 13' upward. A biasing force of the push-up springs 17 makes the slit blade 16 floatable entirely inside the holding frame 14.

Meanwhile, although not illustrated herein, a slit drive rod to reciprocally drive the slit inner blade 1' in the right-to-left direction inside the slit blade 16 extends from one of the paired drive rods 8. In this structure, when the blade frame part 4 is attached to the body part 3, a center lower portion of the slit inner blade 1' is connected to the slit drive rod, which allows the slit inner blade 1' and the slit drive rod to reciprocate together.

The following structure allows the outer blade cassette to be attached to the outer peripheral frame 12. Specifically, resilient pieces 18 extend downward respectively from both right and left side portions of the holding frame 14 of the outer blade cassette 11. Each of these paired right and left resilient pieces 18 has a through hole 19 penetrating therethrough in the right-to-left direction. Moreover, a release button 20 having, as a whole, an L-shape opened toward the outer side extends from the lower end of each resilient piece 18. Furthermore, the tubular outer peripheral frame 12 whose upper and lower ends are opened has recessed portions 21 respectively in both right and left side portions of its lower edge. A hook 22 (see FIG. 8) protrudes inward from a bottom portion of each recessed portion 21 of the outer peripheral frame 12.

An upper end opening 12*a* of the outer peripheral frame 12 is formed smaller than the outline of the holding frame 14 of the outer blade cassette 11 but larger than the outline of an entire blade surface formed of the outer blades 5 and the slit outer blade 5'. In addition, a lower end opening 12*b* of the outer peripheral frame 12 is formed larger than the outline of the holding frame 14 excluding the release buttons 20. Accordingly, when the outer blade cassette 11 is inserted into the outer peripheral frame 12 through the lower end opening 12*b* by letting the release buttons 20 on both right and left ends enter the respective recessed portions 21 as indicated by the arrow in FIG. 4, upper surfaces of the release buttons 20 on both right and left ends come into contact with bottom surfaces of the recessed portions 21. At this position, a tip portion of each hook 22 protruding inward from the outer peripheral frame 12 is hooked over an upper half of a corresponding one of the through holes 19 of the resilient pieces 18 of the holding frame 14 (see FIG. 8) from the outer side. By this hooking, the holding frame 14 is attached to the outer peripheral frame 12.

Each release button 20 of the holding frame 14 with the outer peripheral frame 12 attached thereto is provided in such a way that its tip protrudes outward farther than an outer surface of the outer peripheral frame 12 is. To release the attached state of the holding frame 14 and the outer peripheral frame 12, the hooks 22 should be removed from the through holes 19 by pinching and depressing inward operation surfaces 20*a* in the tips of the respective right and left release buttons 20 in such a way to sandwich them and thereby deflect resilient pieces 18 on the both side inward.

In addition, the following structure allows the blade frame part 4 having the above structure to be attached to the body part 3. Specifically, release buttons 23 are provided respectively to both right and left ends of the body head part 7 of the body part 3 in such a way that they can protrude and can be depressed. In addition, a hook 24 which is bent in an L-shape opened outward is provided in an upper end portion of each of the paired right and left release buttons 23. Each release button 23 is applied with an outward biasing force by a push-out spring (not shown) provided in the body head part 7.

Note that in the following text, the release buttons 20 on the blade frame part 4 side and the release buttons on the body head part 7 side are respectively called "frame-side release buttons 20" and "body-side release buttons 23" in order to distinguish them.

Figure 8:
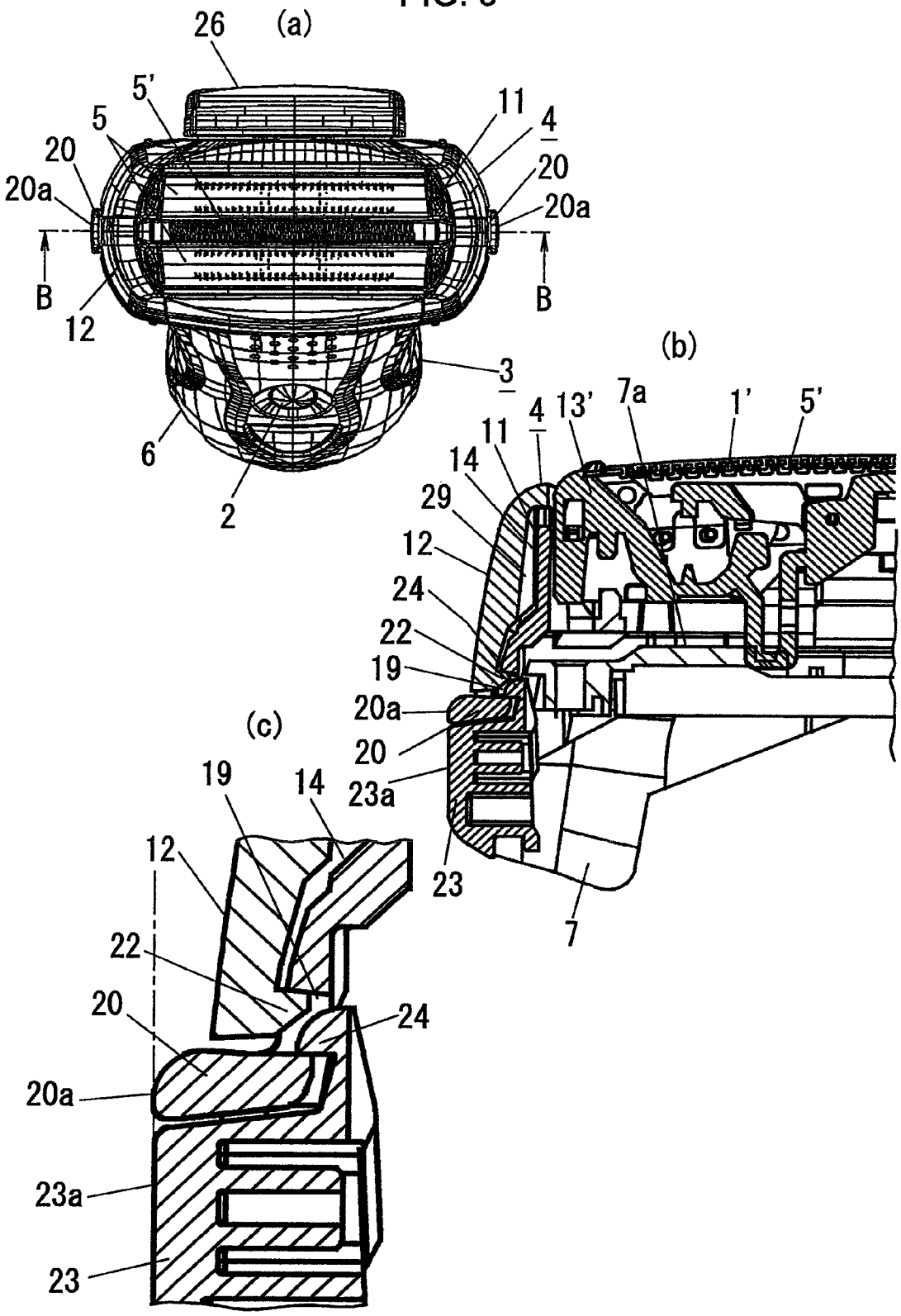
FIG. 8(*a*) is a plan view of FIG. 7, FIG. 8(*b*) is a cross-sectional view taken along the B-B line of FIG. 8(*a*), and FIG. 8(*c*) is an enlarged view of a main part of FIG. 8(*b*).

Accordingly, when the body part 3 is covered by the blade frame part 4 from above by letting the body-side release buttons 23 respectively enter the recessed portions 21 on both right and left sides of the outer peripheral frame 12 as indicated by the arrow in FIG. 6, the body-side release buttons 23 come into contact with the frame-side release buttons 20 of the holding frame 14 inside the right and left recessed portions 21, respectively, as shown in FIG. 8. At this position, a tip portion of each hook 24, which is bent outward from the upper end of the corresponding body-side release button 23, is hooked over a lower half of a corresponding one of the through holes 19 of the resilient pieces 18 of the holding frame 14 from the inner side. By this hooking, the holding frame 14 (consequently the entire blade frame part 4 through the holding frame 14) is attached to the upper end of the body head part 7 of the body part 3.

While the blade frame part 4 is attached to the body head part 7, each body-side release button 23 is provided in such a way that its tip protrudes outward farther than outer surfaces of the outer peripheral frame 12 and the body head part 7 are. To release the attached state of the holding frame 14 and the body head part 7, the hooks 24 should be removed from the through holes 19 by pinching and pressing operation surfaces 23*a* in the tips of the respective right and left body-side release buttons 23 to thereby depress the body-side release buttons 23 inward with respect to the holding frame 14.

As described above, the structure of the electric shaver of the embodiment allows the holding frame 14 of the outer blade cassette 11 to be detachably attached to the body head part 7, from which the inner blades 1 protrude, of the body part 3 from above in such a way to cover the inner blades 1. Moreover, the structure allows the outer peripheral frame 12 to be detachably attached to the holding frame 14 from above in such a way to cover the entire outer periphery of the holding frame 14. In other words, it is a structure which allows the outer peripheral frame 12 to cover all the parts above the grip part 6 except the blade surface (i.e., outer blades 5 and slit outer blade 5'), and which allows the outer peripheral frame 12 to be detachably attached to the body head part 7 with the holding frame 14 attached to the upper end surface 7*a* of the body head part 7.

In the electric shaver having the above structure, when the motor is turned on by manipulating the switch part 2 in the front surface of the grip part 6, the paired front and rear inner blades 1 reciprocally slide on the inner surface of the outer blades 5 through the paired front and rear drive rods 8, and also the slit inner blade 1' inside the slit blade 16 reciprocally slides on the inner surface of the slit outer blade 5' through the slit drive rod extending from the one of the drive rods 8.

The outer blade frames 13 are disposed vertically movable inside the holding frame 14, and the inner blades 1, which come into press contact with the inner surfaces of the outer blades 5 fixed to the outer blade frames 13, are floatable. Thus, the outer blade frames 13 are floatable through the inner blades 1 while being attached to the body head part 7. In addition, the slit outer blade frame 13' is floatable inside the holding frame 14 through the push-up springs 17 as described above. Accordingly, when the blade surface of the blade head part 4 is pressed against the skin, the floatable outer blade frames 13 and slit outer blade frame 13' follow the skin independently.

The structure of the electric shaver of the embodiment allows the holding frame 14 (i.e., the entire outer blade cassette 11) to be attached to the tubular outer peripheral frame 12 by inserting the holding frame 14 thereto upward from the lower end opening 12*b* side. This allows the outer peripheral frame 12 to cover the entire outer periphery of the holding frame 14. Accordingly, the holding frame 14 itself and the joint portion between the holding frame 14 and the outer peripheral frame 12 are not exposed to the outside, hence imparting the high quality impression. In addition, since the outer blade cassette 11 is a replacement part attachable and detachable to and from the outer peripheral frame 12, and since no cost for enhancing the design of the holding frame 14 of the outer blade cassette 11 is needed, the outer blade cassette 11 as a replacement part can be provided at low cost.

Figure 9:
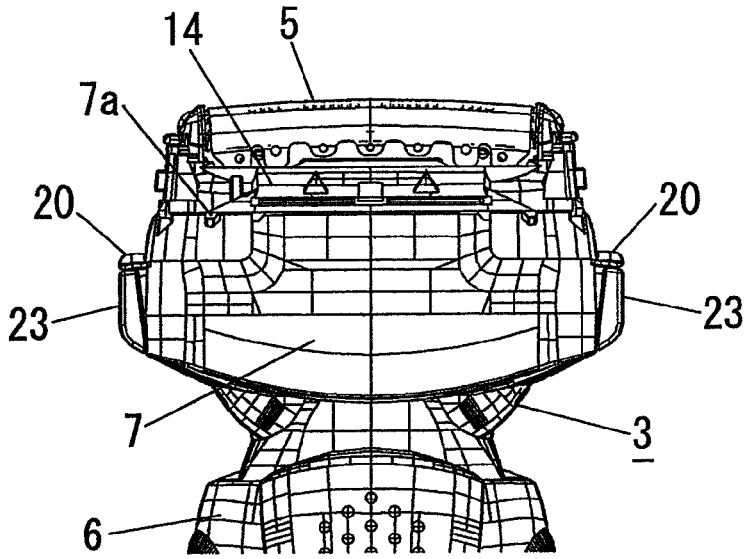
FIG. 9(*a*) is a front view of a main part showing a state where only the outer blade cassette is attached to the body part in the electric shaver of the embodiment, FIG. 9(*b*) is a side view thereof, and the FIG. 9(*c*) is a rear view thereof.
Figure 9:
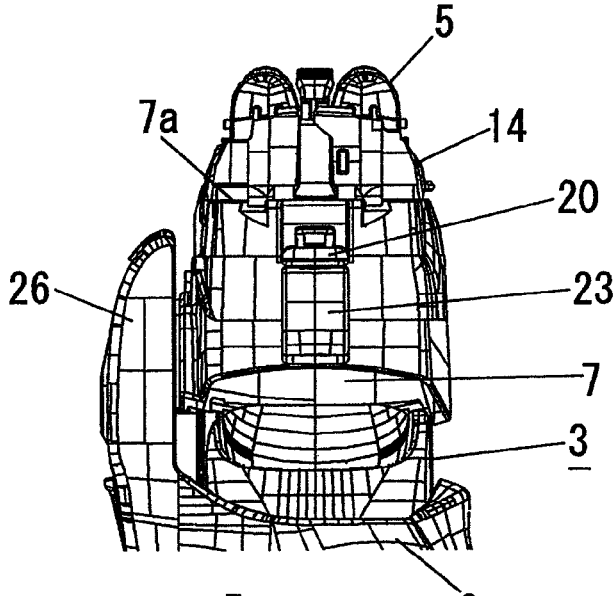
Figure 9:
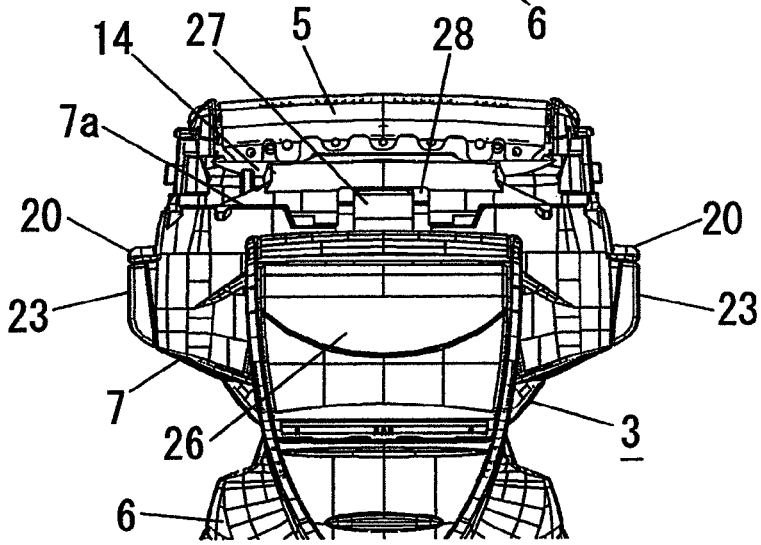
Figure 10:
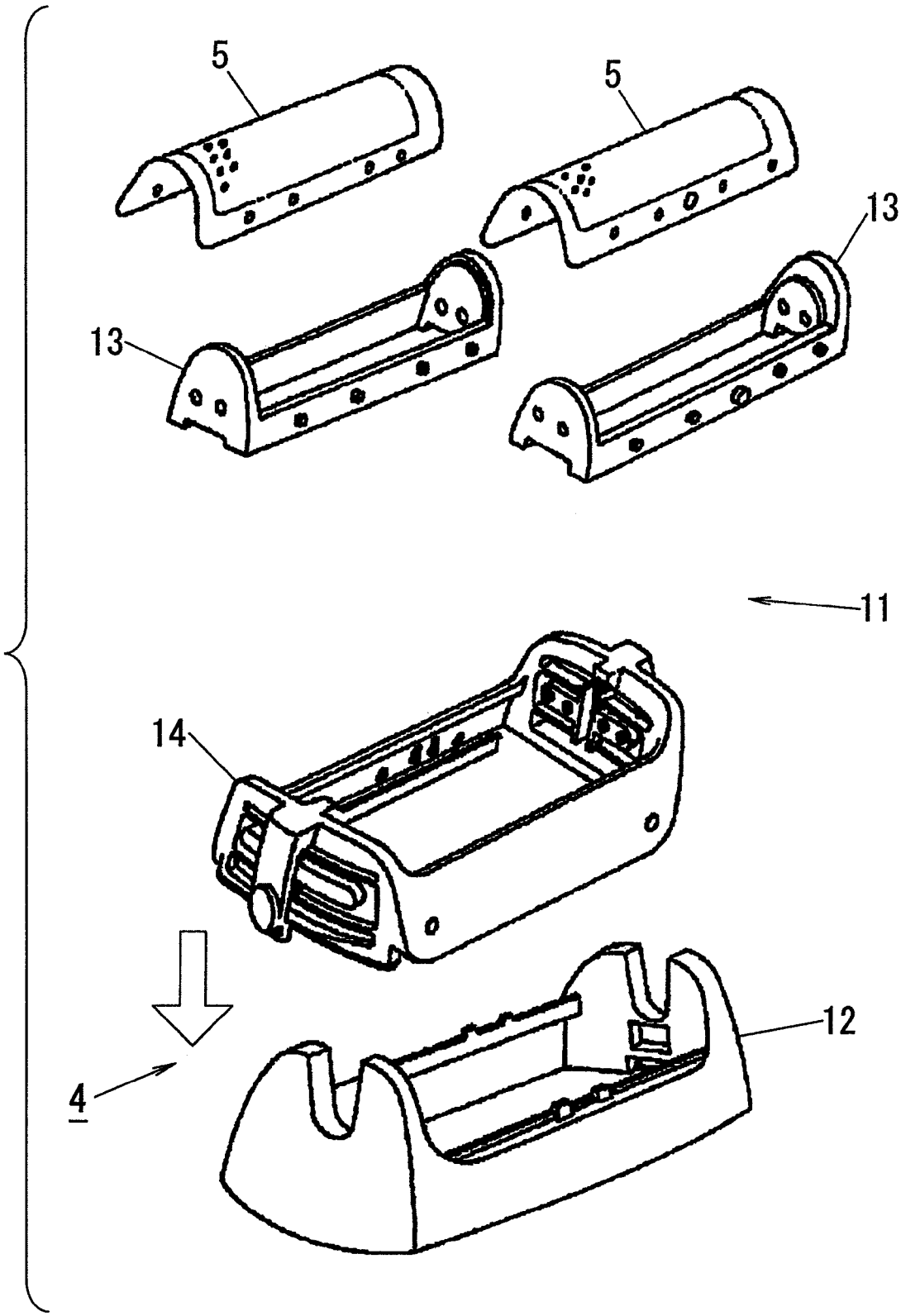
FIG. 10 is an exploded perspective view showing a blade frame part of a conventional electric shaver.

Moreover, the structure of the electric shaver of the embodiment allows the entire blade frame part 4 to be attached to the upper end of the body head part 7 of the body part 3 with the holding frame 14 therebetween. Approximately the entire lower peripheral edge of the holding frame 14 comes into close contact with a peripheral edge portion of the upper end surface 7*a* of the body head part 7 (see FIG. 9). Accordingly, debris of cut hair can be sealed between the holding frame 14 and the upper end surface 7*a* of the body head part 7, hence preventing the hair debris from coming out.

Note that in the embodiment, a trimmer handle 26 having a trimmer blade (not shown) on its upper end is provided in a rear surface of the grip part 6 so as to be vertically slidable. A joint 27 (see FIG. 9(*c*)) extends rearward from the rear drive rod 8 of the body head part 7. Through the joint 27, reciprocation of the drive rod 8 is transmitted to the trimmer blade. Moreover, small gaps 28 for the reciprocation of the joint 27 are provided in a center of a rear portion of the lower edge of the holding frame 14. That is to say, it is a structure which allows the holding frame 14 to come into close contact with the body head part 7 with no gap therebetween, except where the gaps 28 are located. However, if the structure does not include the joint 27, the entire outer periphery of the holding frame 14 may come in close contact with the body head part 7 with no gap therebetween.

In the electric shaver of the embodiment, the holding frame 14 and the outer peripheral frame 12 are connected together by the engagement between the through holes 19 and the hooks 22 at their right and left side portions, as described above (see FIG. 8). However, in portions except these connected portions, a vertically penetrating gap 29 is provided between the holding frame 14 and the outer peripheral frame 12 over the entire outer periphery thereof (see FIG. 5). Since the gap 29 as above is provided, when the blade frame part 4 in the attached state is washed, the entire gap 29 functions as a flow passage of a cleaning liquid. In other words, the gap 29 serving as the flow passage improves the flow of the cleaning liquid inside the blade frame part 4, even though the embodiment employs the structure which allows the outer blade cassette 11 to come in close contact with the upper end of the body head part 7 and which allows the outer peripheral frame 12 to entirely cover the outer blade cassette 11. Accordingly, a high cleaning effect can be obtained.

In the electric shaver of the present invention, each of the body-side release buttons 23, which are provided in the right and left side portions of the body head part 7 in such a way that it can protrude and can be depressed to release the attachment of the holding frame 14 to the body head part 7, has the operation surface 23*a*, whereas each of the frame-side release buttons 20, which are provided in the right and left side portions of the holding frame 14 in such a way that it can protrude and can be depressed to release the attachment of the outer peripheral frame 12 to the holding frame 14, has the operation surface 20*a*. When positioned close to each other in the same plane (see the imaginary line in FIG. 8(*c*)), the operation surface 23*a* and the operation surface 20*a* are approximately flush with each other. Accordingly, the user can manipulate the right and left release buttons 23 and 20 with one hand by placing his/her fingers on the right and left operation surfaces 23*a* and 20*a* to hold the electric shaver and then by depressing, in this state, the right and left release buttons 23 and 20.

Meanwhile, to remove the whole blade frame part 4 from the body head part 7, the operation surfaces 23*a* of the body-side release buttons 23 located on the under side should be depressed. This causes the hooks 24 to move inward together with the body-side release buttons 23 and to get out of the through holes 19. To remove the outer blade cassette 11 from the blade frame part 4 thus removed, the hooks 22 of the outer peripheral frame 12 should be taken out of the through holes 19 by depressing the operation surfaces 20*a* of the frame-side release buttons 20.

Further, to remove only the outer peripheral frame 12 while leaving the holding frame 14 attached to the body head part 7, the operation surfaces 23*a* and 20*a* of the body-side release buttons 23 and the frame-side release buttons 20, which are flushly disposed on the respective right and left sides, should be depressed together. This causes the resilient pieces 18 to deflect inward while leaving the hooks 24 of the body-side release buttons 23 engaged with the through holes 19, whereby only the hooks 22 of the outer peripheral frame 12 get out of the through holes 19. Further, if the holding frame 14 is to be removed after this, the operation surfaces 23*a* of the body-side release buttons 23 should be depressed.

Moreover, as described earlier, the structure of the electric shaver of the embodiment allows both of the hook 24, which is provided on the body head part 7 side and used for connecting the body head part 7 and the holding frame 14, and the hook 22, which is provided on the outer peripheral frame 12 side and used for connecting the outer peripheral frame 12 and the holding frame 14, to be engaged with the single through hole 19 provided in the resilient piece 18 extending from each of the right and left side portions of the holding frame 14.

Thus, according to the electric shaver of the embodiment, it is possible to secure sufficient hook widths of the hooks 24 and 22 while lowering the cost by saving the spaces for the connecting structures and by simplifying a mold structure. It is also possible to achieve further space-saving while securing the hook widths of the hooks 22 and 24, particularly because the structure allows the tip portion of each hook 22, which is bent inward from the corresponding lower end of the outer peripheral frame 12, to be hooked over the upper half of the corresponding through hole 19 from the outer side, and also allows the tip portion of each hook 24, which is bent outward from the corresponding upper end of the body head part 7, to be hooked over the lower half of the corresponding through hole 19 from the inner side. Surfaces of the hooks 22 and 24 which face each other in their hooked states form inclined planes each having an inwardly-inclined upper side. This prevents the hooks 22 and 24 from interfering with each other inside the through hole 19.

As described above, the description is given based on the embodiment in which the outer blade 5, the slit outer blade 5', and the outer blade 5 are disposed in this order in the front-to-rear direction in the blade surface in the upper end of the blade frame part 4. However, the structure of the present invention is applicable as long as it is a structure in which one or more outer blades 5 are disposed in the blade surface.

The electric shaver of the embodiment is an electric shaver in which the blade frame part is attached to the upper portion of the body part, the blade frame part including the outer blade, the outer blade frame to fix the outer blade thereto, the holding frame to hold the outer blade frame vertically movable, and the outer peripheral frame connected to the holding frame, the upper portion including the inner blade. The holding frame is detachably attached to the outer peripheral frame from an under side thereof, and the outer peripheral frame entirely covers the outer periphery of the holding frame which is attached to the outer peripheral frame from the under side. Thus, according to this electric shaver, since the outer blade frames and the holding frame are provided, it is possible to improve the skin-following capability of the outer blades. In addition, according to this electric shaver, since the holding frame is covered by the outer peripheral frame, it is possible to prevent the holding frame and the joint portion between the holding frame and the outer peripheral frame from being exposed to the outside, thereby imparting a high quality impression. Moreover, according to this shaver, it is possible to bring about an effect of saving the cost for outer blade replacement involving removal of the outer blades together with the holding frame.

In addition, the electric shaver of the embodiment has the structure in which the outer peripheral frame is attached to the body part with the holding frame therebetween. Accordingly, an effect of making the blade frame part and consequently the whole electric shaver compact is brought about.

In addition, the electric shaver of the embodiment has the structure in which the holding frame is attached to the body part in close contact therewith. Accordingly, an effect of preventing debris of cut hair from coming out is brought about.

In addition, the electric shaver of the embodiment has the structure in which the gap to allow a cleaning liquid to pass therethrough is provided. The gap functions as a flow passage of the cleaning liquid when the blade frame part in the state of being attached to the body part is washed. This brings about an effect of obtaining a high cleaning effect.

In addition, the electric shaver of the embodiment has the structure in which the operation surface of each of the release buttons, which are provided to release the attachment of the holding frame to the body part, and the operation surface of the corresponding one of the other release buttons, which are provided to release the attachment of the outer peripheral frame to the holding frame, are provided approximately flush with each other. Accordingly, it is possible to manipulate the release buttons alternatively or simultaneously with the fingers of one hand touching both of the flushly-arranged operation surfaces. This brings about an effect of facilitating attachment and removal work.

In addition, the electric shaver of the embodiment has the structure in which: the through holes are provided in the side portions of the holding frame; the holding frame is attached to the body part by causing the hooks provided to the body part to be hooked over portions of the through holes; and the outer peripheral frame is attached to the holding frame by causing the hooks provided to the outer peripheral frame to be hooked over other portions of the through holes. This brings about an effect of sufficiently securing the hook widths of the hooks, while saving the spaces for the connection structures and also lowering the cost by simplifying a mold structure.

INDUSTRIAL APPLICABILITY

The present invention brings about effects of: as a matter of course, improving the skin-following capability of the outer blades by including the outer blade frames and the holding frame; imparting a high quality impression by covering the outer blade frames and the holding frame with the outer peripheral frame to thereby prevent the holding frame and the joint portion between the holding frame and the outer peripheral frame from being exposed to the outside; and also saving the cost for outer blade replacement involving removal of the outer blades together with the holding frame.

The invention claimed is:

1. An electric shaver, comprising:

a blade frame part attached to an upper portion of a body part, the blade frame part including an outer blade, an outer blade frame to fix the outer blade thereto, a holding frame to hold the outer blade frame vertically movable, and an outer peripheral frame connected to the holding frame, the upper portion including an inner blade, and the electric shaver further comprising: the holding frame being detachably attached to the outer peripheral frame from an under side thereof, the outer peripheral frame entirely covering an outer periphery of the holding frame which is attached to the outer peripheral frame from the under side, the outer peripheral frame being attached to the body part via the holding frame, and an operation surface of a first release button provided to release attachment of the holding frame to the body part and an operation surface of a second release button provided to release attachment of the outer peripheral frame to the holding frame are provided approximately flush with each other.

2. The electric shaver according to claim 1, wherein the holding frame is attached to the body part in close contact therewith.

3. The electric shaver according to claim 1, further comprising a gap configured to allow a cleaning liquid to pass therethrough, wherein the gap is provided between the holding frame and the outer peripheral frame.

4. The electric shaver according to claim 1, further comprising:

a through hole provided in a side portion of the holding frame, the holding frame is attached to the body part by causing a hook provided to the body part to be hooked over a portion of the through hole, and the outer peripheral frame attached to the holding frame by causing a hook provided to the outer peripheral frame to be hooked over another portion of the through hole.

5. The electric shaver according to claim 1, wherein the holding frame is provided with the first release button and the second release button at an outer periphery thereof, and wherein the first release button and the second release button extend through corresponding recesses provided in an outer surface of the outer peripheral frame.

* * * * *